US010099285B2

(12) United States Patent
Vincent

(10) Patent No.: US 10,099,285 B2
(45) **Date of Patent: *Oct. 16, 2018**

(54) METAL TRANSFER DEVICE

(71) Applicant: Pyrotek Engineering Materials Limited, Milton Keynes (GB)

(72) Inventor: Mark Vincent, Bedfordshire (GB)

(73) Assignee: PYROTEK ENGINEERING MATERIALS LIMITED, Milton Keynes (GB)

( * ) Notice: Subject to any disclaimer, the term of this patent is extended or adjusted under 35 U.S.C. 154(b) by 150 days.

This patent is subject to a terminal disclaimer.

(21) Appl. No.: 15/251,802

(22) Filed: Aug. 30, 2016

(65) Prior Publication Data

US 2017/0106441 A1 Apr. 20, 2017

(30) Foreign Application Priority Data

Oct. 20, 2015 (GB) ..... 1518505.1

(51) Int. Cl.

| | |
|---|---|
| ***B22D 35/06*** | (2006.01) |
| ***B22D 35/04*** | (2006.01) |
| ***F27D 3/14*** | (2006.01) |

(52) U.S. Cl.
CPC ..... *B22D 35/06* (2013.01); *B22D 35/04* (2013.01); *F27D 3/145* (2013.01)

(58) Field of Classification Search
CPC ..... B22D 35/04
See application file for complete search history.

(56) References Cited

U.S. PATENT DOCUMENTS

| | | | | |
|---|---|---|---|---|
| 9,248,497 B2 * | 2/2016 | Vincent | ..... | B22D 35/04 |
| 2011/0139797 A1 | 6/2011 | Reeves et al. | | |

FOREIGN PATENT DOCUMENTS

| | | | | |
|---|---|---|---|---|
| GB | 2492106 A | | 12/2012 | |
| GB | 2522349 A | * | 7/2015 | ..... B22D 35/04 |

* cited by examiner

*Primary Examiner* — Scott R Kastler
(74) *Attorney, Agent, or Firm* — Knobbe Martens Olson & Bear LLP

(57) ABSTRACT

A metal transfer device including a cast trough body that includes a vessel for receiving liquid metal, a heater for heating the trough body, and a reinforcing layer provided on an outer surface of the cast trough body between the trough body and the heater. The reinforcing layer includes a composite ceramic material having a high thermal conductivity.

21 Claims, 2 Drawing Sheets

METAL TRANSFER DEVICE

RELATED APPLICATION

This application claims priority to Great Britain Patent Application No. GB 1518505.1, filed Oct. 20, 2015, the entire content of which is incorporated herein by reference.

FIELD OF THE INVENTION

The present invention relates to a metal transfer device for transferring liquid metals and in particular, but not exclusively, for transferring metals such as aluminium, zinc and alloys of these and other non-ferrous metals.

BACKGROUND

Metal transfer devices known as "launders" are widely used for transferring liquid metal in metal refining and processing plants, for example from a furnace to a mould. A typical launder comprises a trough made of a refractory material, through which the metal flows under the influence of gravity.

Launders may be either unheated or heated. Heated launders are preferred for certain applications, as they help to maintain the temperature of the metal as it is transferred. Preheating the launder also reduces the thermal shock on the refractory material as the liquid metal is introduced, thereby reducing the risk of cracking.

An example of a heated launder is described in US 2010/0109210 A1. This device includes a trough body for carrying liquid metal, a heating element positioned adjacent the trough body, an insulating layer and an outer shell defined by a bottom and two side walls. The trough body is made of a thermally conductive castable refractory material, which allows heat to be transferred from the heating elements to the liquid metal. The thermal conductivity of the trough body depends on the refractory material from which it is made, being in the range of about 9 to 11 W/m·K for silicon-carbide based refractories, but only about 1.5 to about 1.9 W/m·K for alumina-based refractories. As a result, the efficiency of heat transfer is limited, particularly when an alumina-based refractory is used.

Another problem is that if the trough body cracks, it may be possible for liquid metal to leak through to the heating elements, which could be damaged by contact with the liquid metal.

WO2012/0175911A describes another heated launder, which includes a cast trough body for receiving liquid metal, a metallic shell and a filler layer comprising a cast refractory material between the trough body and the shell. The filler layer has a high thermal conductivity to transfer heat efficiently from a heater to the trough body. The filler layer and the metallic shell prevent any leakage of liquid metal if the cast trough body cracks.

We have found that in certain circumstances differential thermal expansion of the filler layer and the metallic shell can cause the shell to become distorted. Also, if the liquid metal is held in the launder for an extended period of time, it may be difficult to achieve the heat input necessary to maintain the metal in a liquid state.

It is an object of the present invention to provide a metal transfer device that mitigates one or more of the aforesaid disadvantages.

SUMMARY

According to one aspect, there is provided a metal transfer device that includes a cast trough body comprising a vessel for receiving liquid metal, a heater for heating the trough body, and a reinforcing layer provided on an outer surface of the cast trough body, said reinforcing layer comprising a composite ceramic material.

The composite ceramic material may include a fibrous reinforcing material embedded in a ceramic matrix. The reinforcing layer is located between the trough body and the heater and covers an outer surface of the cast trough body. For example, in one embodiment the reinforcing layer covers the base and side walls of the cast trough body. The reinforcing layer provides a barrier to leaking metal, preventing it from reaching the heater and other non-sacrificial components of the metal transfer device in the event that the trough body develops a leak. It is also supports and reinforces the trough body.

In one embodiment, the reinforcing layer comprises composite ceramic material having a high thermal conductivity. This ensures efficient transfer of heat from the heater to the trough body. As a result it is possible to achieve the heat input necessary to maintain the metal in a liquid state, even if the liquid metal is held in the launder for an extended period of time.

As the reinforcing layer is not made of a metal and has a similar coefficient of thermal expansion to that of the trough body, it does not experience significant differential thermal expansion relative to the trough body and so does not become distorted as the temperature changes.

The provision of a reinforcing layer also enables the use of different materials for the trough body, allowing it to be optimised according to the intended application of the metal transfer device. For example, the material of the trough body can be chosen to provide high thermal conductivity, high thermal shock resistance or high wear resistance. The metal transfer device can therefore be used with a variety of different metals in numerous different applications.

In an embodiment, the composite ceramic material of the reinforcing layer has a thermal conductivity of at least 3 W/m·K, preferably at least 5 W/m·K, more preferably at least 7 W/m·K.

In an embodiment, the composite ceramic material includes a fibrous reinforcing fabric embedded in a ceramic matrix.

In one embodiment, the ceramic matrix is based on silicon carbide. The silicon carbide (SiC) is used as a filler in the ceramic matrix. Because SiC has a high thermal conductivity (approximately 360 W/mK) it imparts a high thermal conductivity to the ceramic matrix. SiC is readily available and relatively inexpensive. In other embodiments, the ceramic matrix comprises at least 15% wt silicon carbide, at least 35% wt silicon carbide, or at least 55% wt silicon carbide. The ceramic matrix may also include other filler materials such as silicon diboride, alumina and/or metal fines for increased thermal conductivity.

In an embodiment, the fibrous reinforcing material comprises glass fibers, ceramic fibers and/or carbon fibers. In another embodiment, the fibrous reinforcing fabric comprises glass fibers, such as S-glass and/or E-glass fibers. The fibrous reinforcing fabric may comprise a woven or non-woven fabric (a woven fabric being preferred).

In one embodiment, the composite ceramic material comprises 1-15 layers of fibrous reinforcing fabric, preferably 2-7 layers, more preferably 3-4 layers.

In other embodiments, the composite ceramic material has a thickness in the range 2-10 mm, 3-7 mm, or 3-4 mm.

The metal transfer device may include a detector for detecting leakage of liquid metal. This detector may be used to alert an operator to a leakage, who can then take steps to repair the leak before the leaking metal causes damage to the heater or other non-sacrificial components of the device.

The detector may comprise one or more electrically conductive elements. In one embodiment, the detector is located adjacent an outer surface of the trough body. In another embodiment, the detector is located against the base of the trough body. Advantageously, the detector is embedded within the composite ceramic material of the reinforcing layer adjacent an outer surface of the trough body.

In an embodiment, the cast trough body and the reinforcing layer form a unitary component, which is constructed and arranged to be separable from any components of the metal transfer device located externally of the unitary component (for example, the heater, insulation, outer casing and/or top cover). This allows the unitary component to be readily replaced, for example if the trough body becomes worn or damaged.

In one embodiment, the metal transfer device includes an outer casing located externally of the heater.

In another embodiment, the metal transfer device includes an insulating layer located between the heater and the outer casing.

In another embodiment, the metal transfer device includes an air gap between the insulating layer and the outer casing. This allows the position of the heater or heaters to be adjusted and allows the trough and insulating layer to be removed and replaced.

In another embodiment, the metal transfer device includes a top cover. The device may also include an insulating layer located beneath the top cover.

In one embodiment, the metal transfer device comprises a launder having an open-ended and open-topped flow channel for a flow of liquid metal, which flows from one end of the trough to the other end.

Certain embodiments of the invention will now be described by way of example with reference to the accompanying drawings.

DETAILED DESCRIPTION OF THE PREFERRED EMBODIMENTS

Figure 1:
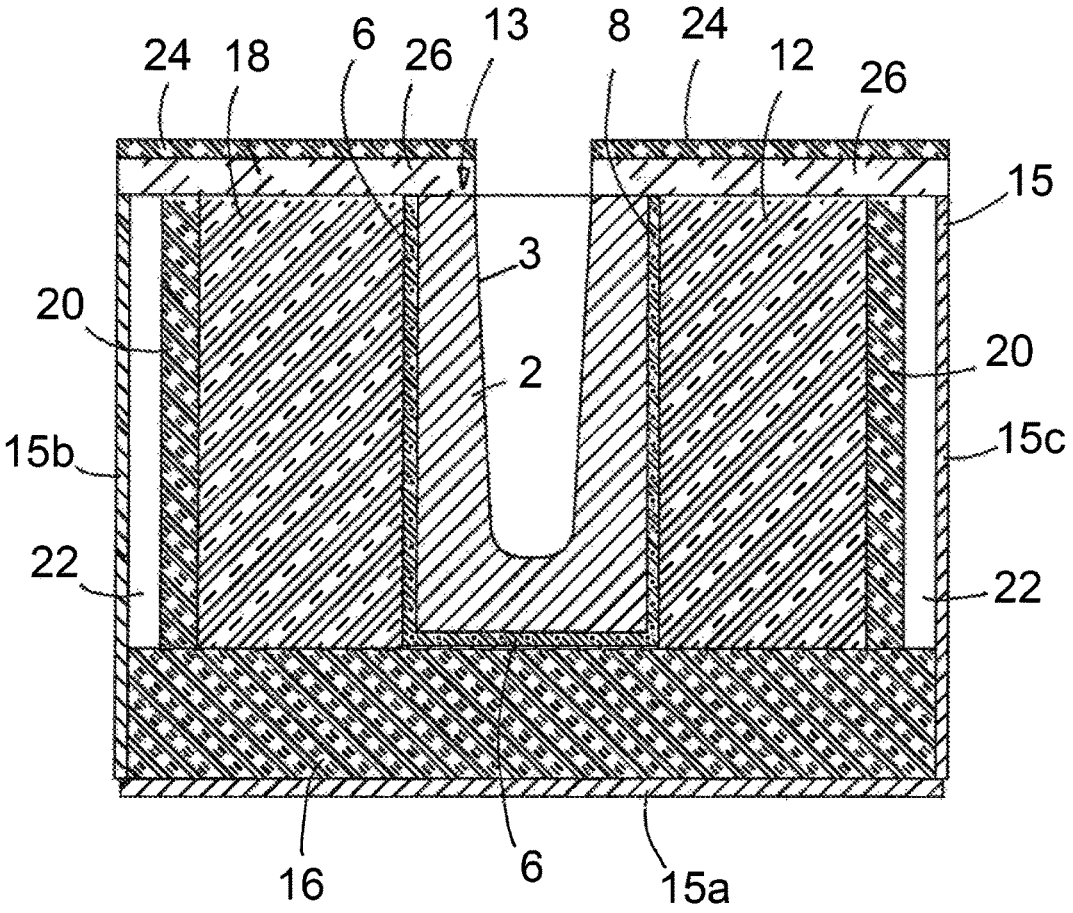
FIG. 1 is a cross-sectional view through a metal transfer device.
Figure 2:
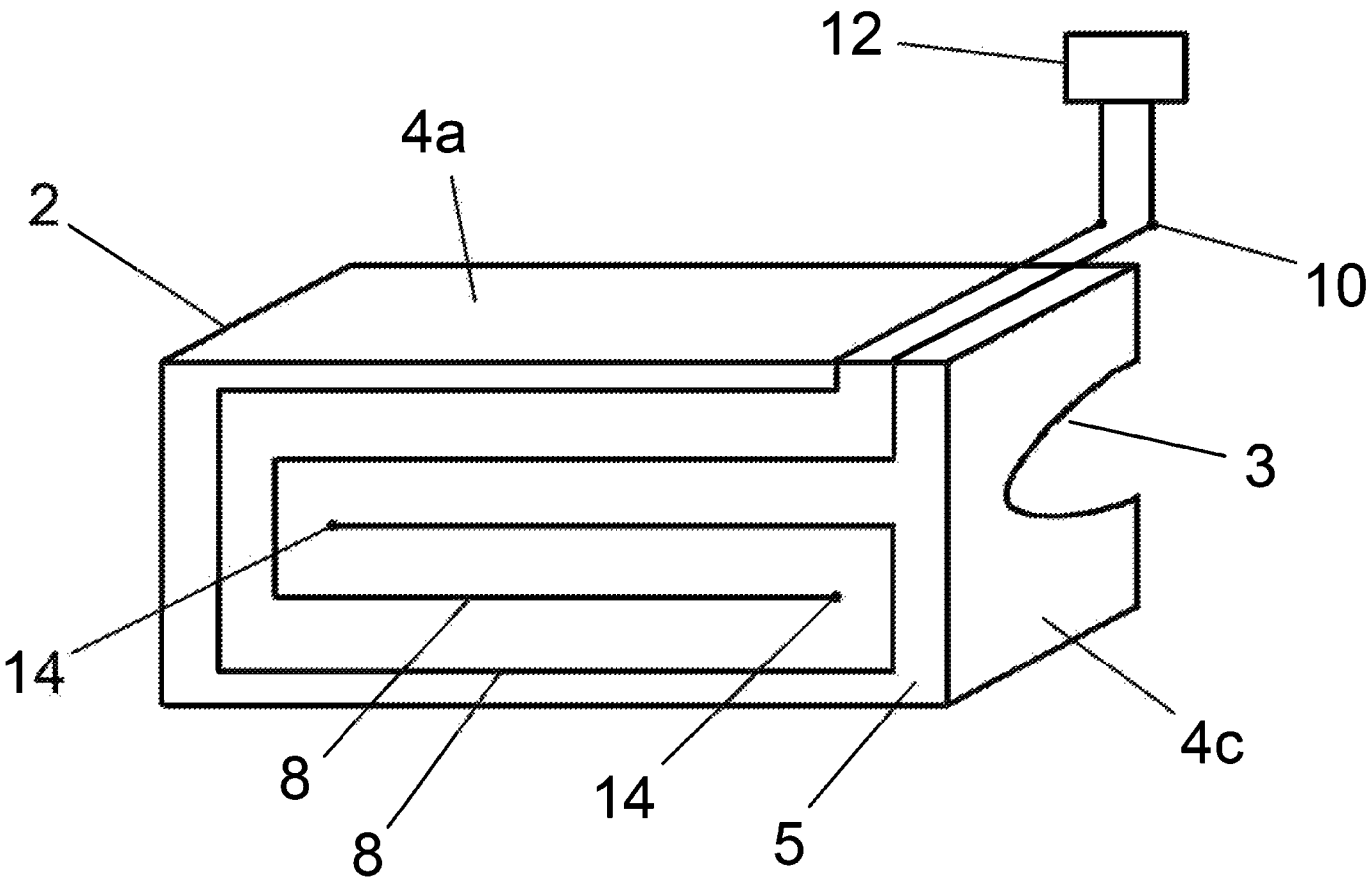
FIG. 2 is an isometric view of a trough body, comprising part of the metal transfer device of FIG. 1.

The metal transfer device 1 shown in FIGS. 1 and 2 comprises a launder: that is, it consists of a trough through which liquid metal can be poured, for example from a furnace to a mould. The device is elongate and has a substantially uniform transverse cross-section as shown in FIG. 1.

The metal transfer device 1 includes a trough body 2 comprising a vessel in the form of a U-shaped trough for receiving liquid metal. The trough body 2 defines an open-topped, open-ended channel 3 for containing the liquid metal as it flows through the device. The trough body 2 is preferably made of a cast refractory material. For example, the trough body may be made of fused silica ($SiO_2$) or alumina ($Al_2O_3$), depending on the application for which the device is intended.

The trough body 2 has an outer surface comprising a pair of side walls 4*a*, 4*b* and a base 5, which are covered by a reinforcing layer 6 comprising a composite ceramic material that includes a fibrous reinforcing material embedded in a refractory ceramic matrix. The end walls 4*c*, 4*d* of the trough body 2 are not covered by the reinforcing layer 6.

The ceramic matrix may for example be based on silicon carbide and preferably comprises at least 15% wt silicon carbide, more preferably at least 35% wt, most preferably at least 55% wt. The refractory ceramic matrix material may also contain other filler materials such as metallic fines for increased thermal conductivity.

Other filler materials such as silicon diboride or aluminium nitride can also be used in the ceramic matrix, either as the main component of the matrix material or as additional components within a silicon carbide-based refractory material. Silicon diboride and aluminium nitride both have an extremely high thermal conductivity but they are very expensive and so their use may be limited to only the most demanding applications.

Materials having slightly lower thermal conductivities, such as alumina and silicon nitride, may also be used in less demanding applications.

The fibrous reinforcing material may be based on glass fibers, ceramic fibers and/or carbon fibers. In one embodiment, the fibrous reinforcing material comprises glass fibers, such as S-glass and/or E-glass fibers. The fibrous reinforcing material may consist of a woven or non-woven fabric.

In one embodiment, the composite ceramic material comprises 2-15 layers of fibrous reinforcing fabric. In one embodiment, the composite ceramic material comprises 3-7 layers of fibrous reinforcing fabric. It may have a thickness in the range 2-10 mm, 3-7 mm, or 4-6 mm.

In one embodiment, the reinforcing layer 6 has a high thermal conductivity: that is, a thermal conductivity of at least 3 W/m·K, at least 5 W/m·K or at least 7 W/m·K.

As an example, the composite ceramic material may have the following formulation:

EXAMPLE

| Material | Function | % wt | Kg |
|---|---|---|---|
| Silicon carbide −325 mesh | High thermal conductivity filler | 59.51 | 5.951 |
| Calcined alumina d50 = 3.5 MY | Rheology modifier | 12.20 | 1.22 |
| Rhodopol gum | Thickening agent | 0.1 | 0.01 |
| Colloidal silica (Nalco ™ 1140) | Binding agent | 28.19* | 2.819* |
| Totals | | 100 | 10 |

*The quoted colloidal silica values include 60% water

A detector 8 for detecting leakage of liquid metal from the trough body 2 may be provided adjacent an outer surface of the trough body 2. An example is shown in FIG. 2, wherein the reinforcing layer has been omitted to show the detector 8. The detector 8 comprises one or more electrical conductors, for example wires, that are embedded within the reinforcing layer 6 at the outer surface of the trough body 2. The detector wires 8 are wrapped backwards and forwards over the base 5 of the trough body 2 so that a leak can be detected. Optionally, detector wires may also be placed on the sides of the trough body.

Any suitable wrapping pattern can be used, providing that the detector wires 8 do not cross over each other and the pitch between the adjacent wires is reasonably small (for example, about 1-5 cm). In the embodiment of FIG. 2, the strands of wire 8 run backwards and forwards along the length of the base 5 of the trough body 2. One end 10 of each wire extends upwards along one of the side walls 4*a* and projects beyond the upper edge of the trough body 2 so that it can be connected to an external detector device 12. The other end 14 of each wire is located against the base 5 of the trough 2 and is embedded within the reinforcing layer 6.

The trough body 2, the reinforcing layer 6 and the detector wires 8 together comprise a unitary structure that is separable from the other parts of the metal transfer device, which are described below. This unitary structure, which will be referred to herein as a trough cartridge 13, may be made and sold separately as a replaceable component of the metal transfer device.

The trough cartridge 13 may be manufactured as follows. First, the trough body 2 is formed or moulded into the "green state" from a suitable castable refractory material, and is then fired at an elevated temperature to produce a hard ceramic-like structure having the desired shape. The detector wires 8 are then attached to the external surface of the trough body 2 in the chosen wrapping pattern, for example using adhesive tape.

The reinforcing layer 6 is then applied to the outer surfaces 4*a,* 4*b,* 5 of the trough body 2. The reinforcing layer 6 is built up by laying a sheet of fibrous reinforcing fabric on the outer surfaces 4*a,* 4*b,* 5 of the trough body 2 and then rubbing a slurry of the chosen ceramic matrix material through the fibrous reinforcing fabric, so that it adheres to the trough body 2. This process is repeated as necessary until the reinforcing layer 6 achieves the desired thickness. The reinforcing layer 6 is then dried in an oven and fired to form a hard and strong skin on the outer surfaces 4*a,* 4*b,* 5 of the trough body 2.

The detector wires 8, held in place by adhesive tape, are covered by the reinforcing layer 6 as it is built up. During firing, the adhesive tape is burnt away, leaving the wires embedded within the reinforcing layer 6 adjacent the outer face of the trough body 2.

The outer part 14 of the metal transfer device includes a metal outer casing 15, which is made for example of steel and comprises a base 15*a* and two side walls 15*b* forming a U-shaped channel. A base layer 16 of thermal insulating material, for example low density fiber board, fills the lower part of this channel and supports the trough cartridge 13.

Mounted within the casing 15 adjacent the sides of the trough cartridge 13 are a pair of heater panels 18, each comprising an electrical heating element embedded within a ceramic support matrix. These heater panels 18 can be moved horizontally within the casing 15 towards or away from the trough cartridge 13 and can be clamped in the chosen position. During operational use, the heater panels 18 are positioned against the reinforcing layer 6 of the trough cartridge 13, to ensure efficient transfer of heat from the heater panels into the trough body 2. The heater panels 18 can also be moved away from the trough cartridge 13 to allow removal and replacement of the trough cartridge 13 if it becomes worn or damaged.

Each heater panel 18 includes on its outer face an insulating layer 20 of a suitable thermal insulating material, for example low density fiber board. An air gap 22 is provided between the insulating layer 20 and the adjacent side wall 15*b* of the casing to allow for sideways displacement of the heater panel 18, and further to reduce heat transfer to the casing 15. The upper parts of the trough cartridge 13, the casing 15 and the heater panels 18 are covered by a pair of steel top plates 24, each top plate 24 being thermally insulated by an upper layer of insulating material 26, for example a ceramic fiber blanket or low density fiber board. The top plates 24 are either removable or attached to the casing by hinges so that they can be removed or repositioned to allow access to the interior of the metal transfer device, for example for removal and replacement of the trough cartridge 13 or adjustment or maintenance of the heating panels 18.

A complete launder system consists of a number of individual metal transfer devices as described above, which are joined end-to-end to form a continuous channel 3 through which liquid metal can flow. Before pouring the liquid metal, each metal transfer device 1 is pre-heated by supplying electrical current to the heater panels 18, so that the trough body 2 reaches a desired temperature. Usually, this temperature will be close to the temperature of the liquid metal, so that the trough body 2 experiences little or no thermal shock when the metal is poured. Preheating the metal transfer device 1 also ensures that the liquid metal loses little or no heat as it flows through the device. The high thermal conductivity of the reinforcing layer 6 ensures efficient heat transfer from the heater panels 18 to the trough body 2.

The metal transfer device 1 is intended primarily, but not exclusively, for use with non-ferrous metals, for example aluminium or zinc and alloys of those and other non-ferrous metals. It may however also be used for ferrous metals, for example steel.

If the device is intended for use with aluminium or zinc alloys, the trough body 2 may be made for example of a refractory material based on silicon dioxide (fused silica), which has a very low coefficient of thermal expansion and is therefore resistant to thermal shock. This makes it particularly suitable for use in applications where the heaters are frequently turned on and off.

If more aggressive alloys are to be used, such as those containing lithium or magnesium, fused silica may be an unsuitable material for the trough body 2, as it is reduced (eroded) very quickly by these metals. For these applications, it may be preferable to use a refractory material based on alumina (aluminium oxide), which is inert and therefore has much greater resistance to erosion. Normally, alumina would not be considered for use as a trough body material as it has a higher coefficient of thermal expansion and is therefore more vulnerable to thermal shock. However, in the present invention the risk of thermal shock is greatly reduced by the possibility of preheating the device.

For applications in which the temperature of the metal has to be actively controlled, for example in continuous casting operations, it may be preferable to use a refractory material based on silicon carbide for the trough body as this has a very high thermal conductivity, thus ensuring efficient transfer of heat from the heaters.

For each of these applications, the composite ceramic material of the reinforcing layer 6 should have a high thermal conductivity to ensure efficient heat transfer. A silicon carbide based ceramic matrix material is a suitable choice for most applications.

Notwithstanding the advantages provided by preheating the device, it is possible that in time the trough body 2 may crack or fail, allowing liquid metal to leak from the channel 3 towards the heating panels 18 (there being a tendency for liquid metal to flow towards the source of heat). The leaking liquid metal is contained by the reinforcing layer 5 and flows downwards under gravity towards the base 5. The detector unit 12 is designed to apply a small electric potential between the detector wires 8 and to detect a current flowing through the wires. Normally, the wires are electrically insulated from each other and no current flows. However, if a leak occurs and liquid metal reaches the wires it will short circuit them, allowing a current to flow. This current triggers the detector unit 12, which generates an alarm signal to alert an operator that a leak has been detected.

If a leak takes place, the leaking metal is prevented from reaching the heater panels 18 by the reinforcing layer 6. The risk of damage to the outer parts of the metal transfer device 1 is therefore greatly reduced.

Once a leak has been detected, the trough cartridge 13 in the leaking section of the launder system can be easily removed and replaced, without having to replace the outer parts of the metal transfer device 1, owing to its unitary structure.

While the invention has been described largely in connection with its use as a launder system, it will be readily understood that the principals of design and the physical configuration of the device are readily applicable to other liquid metal handling devices, such as holders, crucibles and filters.

It will be apparent to those skilled in the art that the invention as described may be varied in many ways without departing from the spirit and scope of the invention. Any and all such modifications are intended to be included within the scope of the invention as claimed.

What is claimed is:

1. A metal transfer device, comprising:

a cast trough body comprising a vessel for receiving a liquid metal;

a heater for heating the trough body; and a reinforcing layer provided on an outer surface of the cast trough body, said reinforcing layer comprising a composite ceramic material, wherein said composite ceramic material includes a fibrous reinforcing material embedded in a ceramic matrix.

2. The metal transfer device according to claim 1, wherein the composite ceramic material has a thermal conductivity of at least 3W/m·K.

3. The metal transfer device according to claim 1, wherein the ceramic matrix is based on silicon carbide.

4. The metal transfer device according to claim 3, wherein the ceramic matrix comprises at least 15% wt silicon carbide.

5. The metal transfer device according to claim 3, wherein the ceramic matrix includes one or more additional components selected from the group consisting of a rheology modifier, a thickening agent and a binding agent.

6. The metal transfer device according to claim 1, wherein the fibrous reinforcing material comprises glass fibers, ceramic fibers and/or carbon fibers.

7. The metal transfer device according to claim 1, wherein the fibrous reinforcing material comprises glass fibers.

8. The metal transfer device according to claim 1, wherein the fibrous reinforcing material comprises a woven or non-woven fabric.

9. The metal transfer device according to claim 1, wherein the composite ceramic material comprises 1-15 layers of fibrous reinforcing fabric.

10. The metal transfer device according to claim 1, wherein the composite ceramic material has a thickness in the range of 2-10 mm.

11. The metal transfer device according to claim 1, further comprising a detector for detecting leakage of liquid metal.

12. The metal transfer device according to claim 11, wherein the detector comprises one or more electrically conductive elements.

13. The metal transfer device according to claim 11, wherein the detector is located adjacent an outer surface of the trough body.

14. The metal transfer device according to claim 13, wherein the detector is embedded within the reinforcing layer.

15. The metal transfer device according to any claim 1, wherein the cast trough body and the reinforcing layer form a unitary component, which is separable from any components of the metal transfer device located externally of the unitary component.

16. The metal transfer device according to claim 1, further comprising an outer casing located externally of the heater.

17. The metal transfer device according to claim 16, further comprising an insulating layer located between the heater and the outer casing.

18. The metal transfer device according to claim 17, further comprising an air gap between the insulating layer and the outer casing.

19. The metal transfer device according to claim 1, further comprising a top cover.

20. The metal transfer device according to claim 19, further comprising an insulating layer located beneath the top cover.

21. The metal transfer device according to clam 1, wherein the metal transfer device further comprises a launder having a flow channel for a flow of liquid metal.

* * * * *